United States Patent [19]

Hiersteiner

[11] Patent Number: 4,545,521

[45] Date of Patent: Oct. 8, 1985

[54] ENVELOPE WITH HANGER

[75] Inventor: Walter Hiersteiner, Shawnee Mission, Kans.

[73] Assignee: Tension Envelope Corporation, Kansas City, Mo.

[21] Appl. No.: 618,880

[22] Filed: Jun. 8, 1984

[51] Int. Cl.[4] ..... B65D 27/08

[52] U.S. Cl. ..... 229/68 R; 40/331; 229/74; 383/9

[58] Field of Search ..... 229/68 R, 74; 40/331; 383/9; 206/806

[56] References Cited

U.S. PATENT DOCUMENTS

| | | | |
|---|---|---|---|
| 670,186 | 3/1901 | Perry . | |
| 922,600 | 5/1909 | Kruger | 229/82 |
| 965,269 | 7/1910 | Zasmeta . | |
| 1,110,019 | 9/1914 | Webb . | |
| 1,171,006 | 2/1916 | Trenchard, Jr. . | |
| 1,212,852 | 1/1917 | Toupal . | |
| 1,239,976 | 9/1917 | Simonson . | |
| 1,272,394 | 7/1918 | Devney | 40/331 |
| 1,276,735 | 8/1918 | Devney | 40/331 |
| 1,334,967 | 3/1920 | Rottman . | |
| 1,371,813 | 3/1921 | Robinson . | |
| 1,529,381 | 3/1925 | Townsend . | |
| 1,607,631 | 11/1926 | Krueger . | |
| 1,671,775 | 5/1928 | Meikle . | |
| 1,883,108 | 10/1932 | Thompson | 383/9 |
| 1,898,685 | 2/1933 | Reineman . | |
| 1,969,428 | 8/1934 | Schwartz . | |
| 1,984,559 | 12/1934 | Wilcox . | |
| 2,099,029 | 11/1937 | McKay . | |
| 2,289,058 | 7/1942 | McCarthy . | |
| 2,305,426 | 12/1942 | Howell . | |
| 2,437,110 | 3/1948 | Marler . | |
| 2,767,902 | 10/1956 | Hiersteiner . | |
| 4,062,450 | 12/1977 | Carter | 206/806 |
| 4,180,168 | 12/1979 | Hiersteiner . | |
| 4,199,062 | 4/1980 | Johnston et al. | 383/9 |
| 4,201,299 | 5/1980 | Bamgarner et al. . | |
| 4,460,119 | 7/1984 | Goodfellow et al. | 229/74 |
| 4,462,538 | 7/1984 | Gendron | 229/74 |

FOREIGN PATENT DOCUMENTS

| | | | |
|---|---|---|---|
| 2752489 | 5/1979 | Fed. Rep. of Germany | 206/806 |

*Primary Examiner*—Stephen P. Garbe

*Attorney, Agent, or Firm*—Litman, Day and McMahon

[57] ABSTRACT

An envelope comprising a body and a hanger. The body includes front and back panels forming a pocket therebetween and a seal flap. The hanger includes front and back panels which are extensions of the body panels, a doorknob opening and a door handle opening with spaced-apart receivers interconnected by a tear line.

6 Claims, 16 Drawing Figures

Fig. 8.
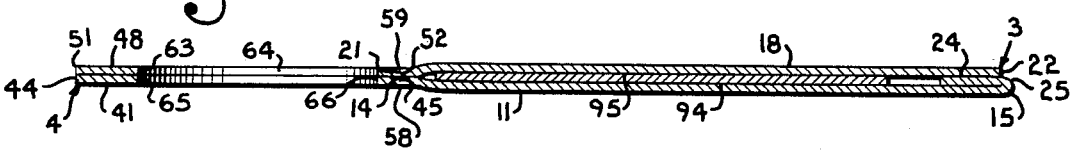
Fig. 9.
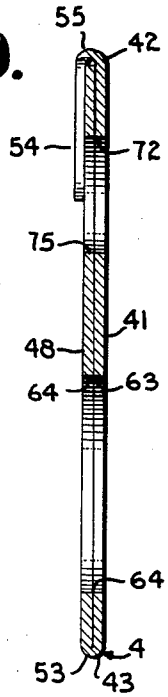
Fig. 10.
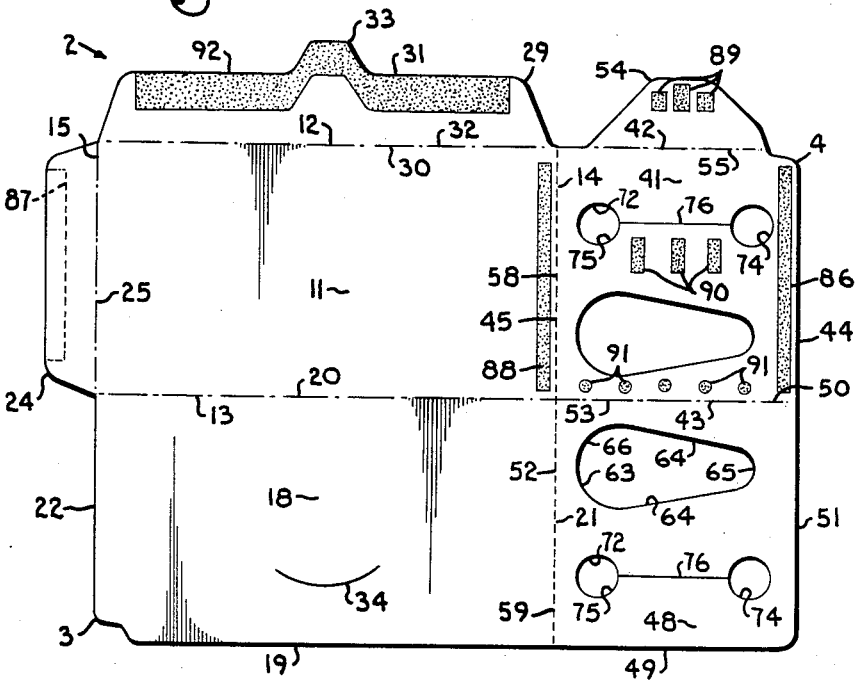
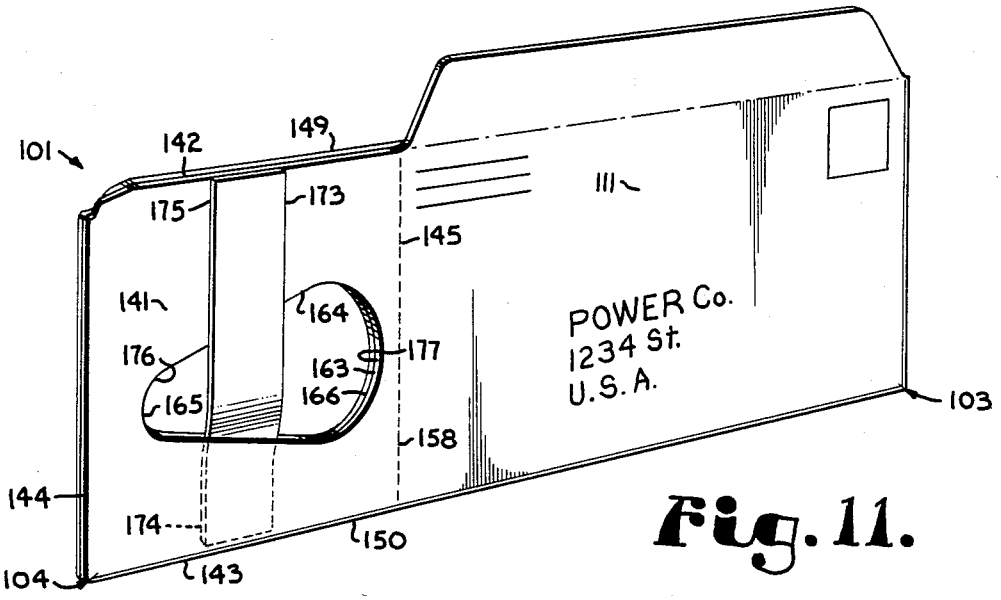
Fig. 11.

ENVELOPE WITH HANGER

BACKGROUND OF THE INVENTION

1. Field of the Invention

The present invention relates to envelopes, and in particular to an envelope for hanging on a doorknob or a door handle.

2. Description of the Prior Art

In commercial transactions, the providers of goods and services often find it more efficient in communicating with their customers to utilize delivery means other than the U.S. Postal Service. For example, invoices and the like are frequently attached to goods to which they pertain whereby the customer is presented with a bill upon receipt of the goods. The prior art includes envelopes specifically designed for this purpose, as exemplified by the Schwartz U.S. Pat. No. 1,969,428 which shows an envelope forming an opening for placement over the neck of a milk bottle.

Envelopes and other items have also heretofore been devised for hanging on doorknobs. Such devices, sometimes called doorknob hangers, are particularly well suited for non-mail delivery to customers because some type of knob can be found on the front door of almost every residence and because non-mail items are prohibited from placement in mail boxes. Items placed on a customer's front door are unlikely to be disregarded or overlooked since the doorknob must generally be manipulated in order to obtain ingress or egress. The probability of receipt of such materials is further increased by the fact that they are displayed in plain view and within easy reach of a person using the front door. Hanging materials on doorknobs is regarded as an effective alternative to conventional mail delivery.

Entities which must provide materials to a relatively high percentage of dwelling units in their particular trade areas may find such door-to-door deliveries much more cost effective than mailings. For example, newspapers and utilities with relatively high percentages of subscribers in their trade areas may find hand delivery of their bills more efficient.

The Wilcox U.S. Pat. No. 1,984,559 shows an envelope with an opening adapted to receive a doorknob or, alternatively, the neck of a milk bottle. The Howell U.S. Pat. No. 2,305,426 discloses a hanger with a doorknob opening and a tongue adapted for attachment to an item such as an envelope.

Bags with doorknob openings are exemplified in the Meikle U.S. Pat. No. 1,671,775 and the Bumgarner et al. U.S. Pat. No. 4,201,299 patents. The Townsend U.S. Pat. No. 1,529,381 discloses an envelope with an opening having slits radiating therefrom and adapted to receive a doorknob.

A problem with many prior art devices for hanging on doorknobs, including the aforementioned, is that they are specifically designed for placement over conventional doorknobs with enlarged outer knob portions connected to doors by smaller-diameter shafts. The hanging device openings receive the smaller diameter shafts whereby the devices are retained in place by the enlarged knob portions. Such devices are often unsuitable for attachment to door handles such as those typically found on storm and screen doors. In recent years rising energy costs have resulted in the installation of large numbers of storm doors. Many storm and screen doors are locked at various times and thus prevent access to the conventional doorknobs on the front doors of dwelling units or other structures.

Heretofore, there has not been available an envelope with a hanger attachement compatible with door handles as well as conventional doorknobs with the particular features and advantages of the present invention.

SUMMARY AND OBJECTS OF THE INVENTION

In the practice of the present invention, an envelope is provided which includes a body and a hanger. The body has front and back panels forming a pocket therebetween and a side flap. The pocket is closed by a seal flap having a tab adapted for insertion into a slit in the back body panel for a first trip. The seal flap is adhesively attached to the body back panel to close the pocket for a second trip. The hanger includes a pear-shaped doorknob opening adapted to receive a doorknob. For attachment to a storm door or screen door with a door handle, the hanger includes a door handle opening comprising a pair of spaced-apart receivers connected by a tear line. The receivers are adapted to receive the door handle when it is pushed through the hanger at the tear line. The hanger includes front and back panels forming extensions of the body front and back panels and demarcated therefrom by tear lines.

The principal objects of the present invention are: to provide an envelope with a hanger adapted for attachment to a variety of different types of doors; to provide such an envelope with a hanger including a doorknob opening and a door handle opening; to provide such an envelope wherein the body includes front and back panels and the hanger includes front and back panels which are extensions of the body front and back panels; to provide such an envelope wherein the body panels form a pocket therebetween adapted to receive materials; to provide such an envelope wherein the pocket is closed by a seal flap releasably attached to a body panel for a first trip and fixedly attached to the body panel for a second trip; to provide such an envelope with a hanger which includes an opening having a tongue extending thereacross for attachment to a doorknob or a door handle; to provide such an envelope which may be manufactured on conventional rotary envelope folding machinery; and to provide such an envelope which is economical to manufacture, efficient in operation, capable of a long operating life and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 8 is a transverse cross section of the envelope taken generally along line 8—8 in FIG. 1.

FIG. 9 is a vertical cross section of the envelope taken generally along line 9—9 in FIG. 1.

FIG. 10 is a plan of a blank for forming the envelope.

FIG. 11 is a perspective of an envelope with hanger comprising a modified embodiment of the present invention.

DETAILED DESCRIPTION OF THE PREFERRED EMBODIMENTS

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
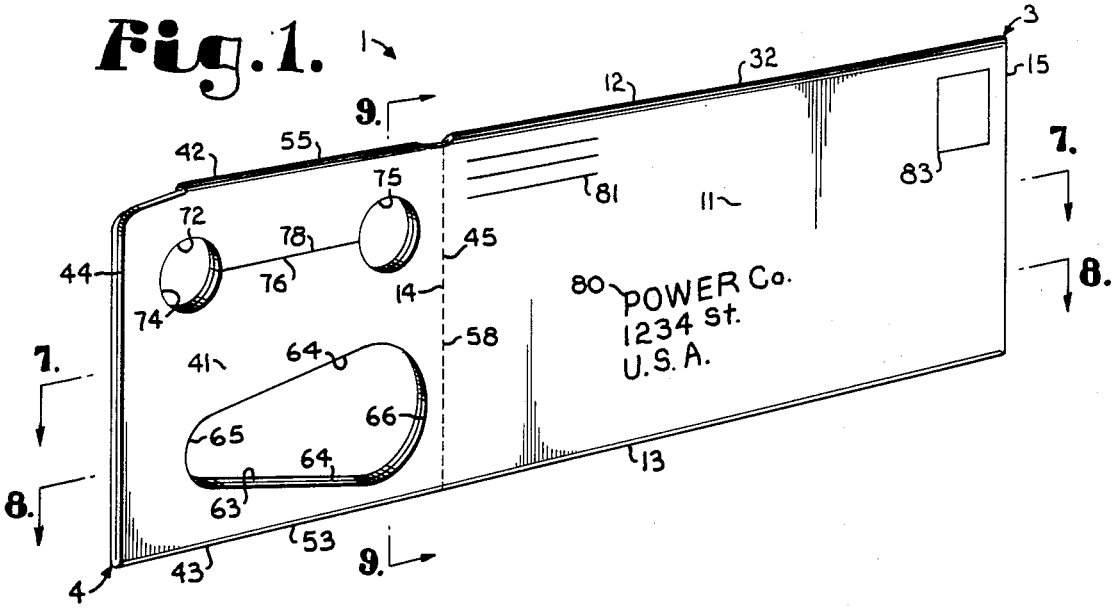
FIG. 1 is a perspective of an envelope with hanger embodying the present invention.

Envelopes embodying the present invention are described herein as oriented in FIGS. 1 and 11. However, such orientation is not to be interpreted as limiting.

Referring to the drawings in more detail, the reference numeral 1 generally designates an envelope comprising a preferred embodiment of the present invention. The envelope 1 is formed from a single-piece blank 2 and generally comprises a body 3 and a hanger 4. The body 3 includes a front panel 11 with upper and lower edges 12, 13 and first and second side edges 14, 15. A body back panel 18 includes upper and lower edges 19, 20 and first and second side edges 21, 22. The front and back panels 11, 18 are integrally connected along and demarcated by a body fold line 23 extending along their respective lower edges 13, 20.

A side flap 24 extends from the front panel second side edge 15 and is demarcated therefrom by a side flap fold line 25. A seal flap 29 includes proximate and distal edges 30, 31 and is integrally connected to and demarcated from the front panel 11 by a seal flap fold line 32 extending along the front panel upper and seal flap proximate edges 12, 30. The seal flap includes an integral tab 33 extending outwardly from its distal edge 31 approximately midway therealong. The tab 33 is releasably received in an arc-shaped slit 34 formed in the back panel 18.

The hanger 4 includes a hanger front panel 41 with upper and lower edges 42, 43 and first and second side edges 44, 45. The hanger 4 also includes a hanger back panel 48 with upper, lower, first side and second side edges 49, 50, 51 and 52 respectively. The hanger panels 41, 48 are integrally connected at and demarcated by a hanger fold line 53 extending along their respective lower edges 43, 50. The hanger fold line 53 is aligned with the body fold line 23.

A stiffener flap 54 extends outwardly from the hanger front panel upper edge 42 and is demarcated therefrom by a stiffener flap fold line 55. The envelope body 3 and the hanger 4 are demarcated by front and back tear lines 58, 59 extending along colinear pairs of panel side edges 14, 44 and 22, 52. As shown in FIG. 10, the tear lines 58, 59 are aligned and continuous across the envelope blank 2 from the front panel upper edges 12, 42 to the back panel upper edges 19, 49.

The hanger 4 includes separate means for hanging the envelope on a doorknob 61 or a door handle 62. The doorknob hanging means comprises a doorknob opening 63 which extends through the hanger panels 41, 48. The doorknob opening 63 includes substantially straight sides 64 converging toward the hanger panel first side edges 44, 51; a rounded, small first end 65 in proximity to and spaced from the hanger panel first side edges 44, 51 and a rounded, large second end 66 in proximity to and spaced from the hanger panel second side edges 45, 52. The doorknob opening 63 is symmetrical about an axis extending between its ends 65, 66 in parallel relation to the hanger fold line 53.

A door handle opening 71 extends through the hanger panels 41, 48 in proximity to and spaced from the hanger panel upper edges 42, 49. As shown in FIG. 1, the door handle opening 71 has a barbell-shaped configuration with first and second receivers 74, 75 in proximity to and spaced from the hanger panel first and second side edges 44, 51 and 45, 52 respectively. The receivers 74, 75 shown are rounded and slightly elliptical with major axes extending parallel to the hanger panel side edges 44, 51 and 45, 52 and minor axes extending parallel to the hanger panel upper edges 42, 49. It will be appreciated that the receivers 74, 75 may assume circular or other alternative configurations. The receivers 74, 75 are interconnected by a tear line 76 aligned with their minor axes and parallel to the hanger panel upper edges 42, 49.

The envelope 1 is designed to permit simple, direct and rapid manufacture with a minimum of operational steps on conventional rotary envelope folding machinery. The blank 2 is die cut in the configuration shown in FIG. 10 and is printed with an identification 79 of the contents which may be readily observed by the recipient on the body back panel 18. An address 80, for example the sender's address, is printed on the body front panel 11. Also printed on the body front panel 11 are lines 81 for a return address and a box 82 for a return stamp. All of the printing is done on one side of the envelope blank 2.

An adhesive strip 86 is applied to the hanger back panel 48 along its first side edge 51. Adhesive strips 87, 88 are applied to the side flap 24 and the front panel 11 inside surface adjacent its first side edge 14 respectively. Adhesive spots 89, 90 and 91 are applied to the stiffener flap 54 inner surface, the hanger front panel 41 inner surface and along the hanger fold line 53 respectively. An adhesive strip 92 is applied to the seal flap 29 inner surface along its distal edge 31. As shown in FIG. 10, the adhesive strip 92 follows the outline of the seal flap distal edge 31 and the tab 33 so that multiple envelope blanks 2 may be placed in a closely-spaced, staggered, aligned relationship for continuous application thereon of the adhesive strips 92. The adhesive strip 92 may be applied, for example, by a conventional seal flap gumming section of a rotary envelope folding machine (not shown).

With the seal adhesive thus applied, the side flap 24 is folded along its fold line 25 over the inside surface of the body front panel 11 and the blank 2 is folded along the body and hanger fold lines 23, 53. The adhesive strips 87, 88 connect the body back panel 18 to the side flap 24 and the front body panel 11 respectively whereby a pocket 95 is formed which is open at a mouth 96 at the body panel upper edges 12, 19. Adhesive spots 89, 90 connect the hanger front and back panels 41, 48 to each other with their respective cutouts for the doorknob opening 63 and the door handle opening 72 aligned. The stiffener flap 54 is folded along its fold line 55 over the hanger back panel 48 and secured to the outer surface thereof by adhesive spots 89.

It will be appreciated that the steps of manufacture may be performed in whatever order is most expedient with the envelope making equipment available to the manufacturer. For example, the doorknob and door handle openings 63, 72 may be formed prior to folding the envelope 1 or, alternatively, may be cut through both hanger panels 41, 48 simultaneously after the envelope 1 is folded and glued.

In use, the pocket 95 receives materials 94 through the mouth 96 between the body panel upper edges 12, 19. The materials 94 may be inserted into the pocket 95 with an automatic envelope stuffer. The seal flap 29 is folded along its fold line 32 over the body back panel 18. The adhesive strip 92 is not moistened at this time, rather the seal flap 29 is retained in position by inserting its tab 33 into the arcuate slit 34.

The envelope 1 is particularly designed for hand delivery. Such hand deliveries are most efficient when the concentration of intended recipients in a given area is relatively high. For example, bills for services such as public utilities, newspapers and the like may be distributed efficiently in this manner because relatively large percentages of households in the sender's trade area will receive bills.

Figure 2:
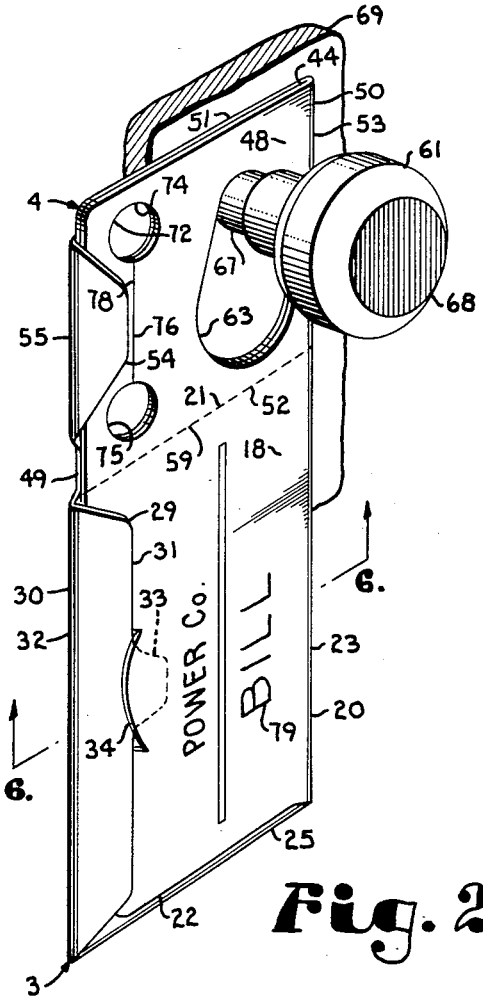
FIG. 2 is a perspective of the envelope attached to a doorknob.
Figure 3:
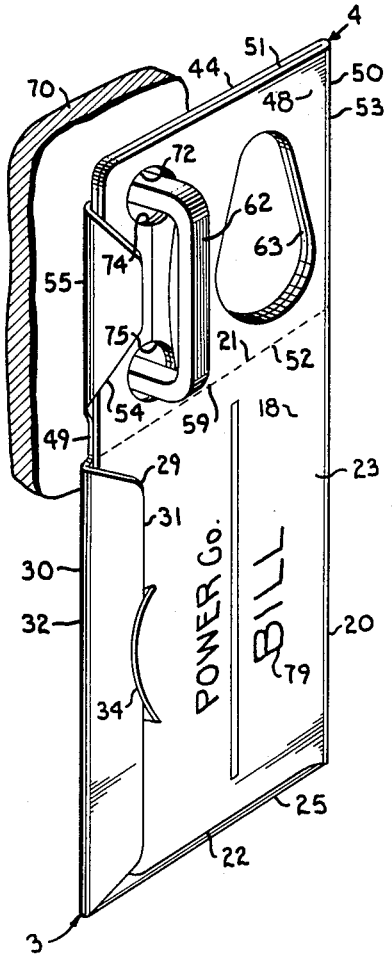
FIG. 3 is a perspective of the envelope attached to a door handle.
Figure 4:
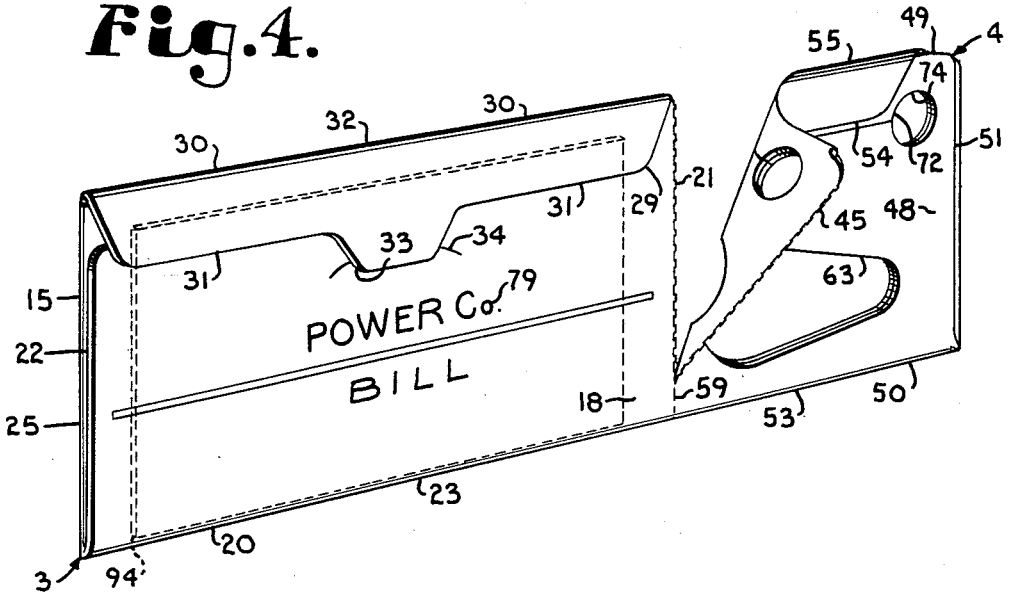
FIG. 4 is a perspective of the envelope showing the hanger being torn therefrom.
Figure 5:
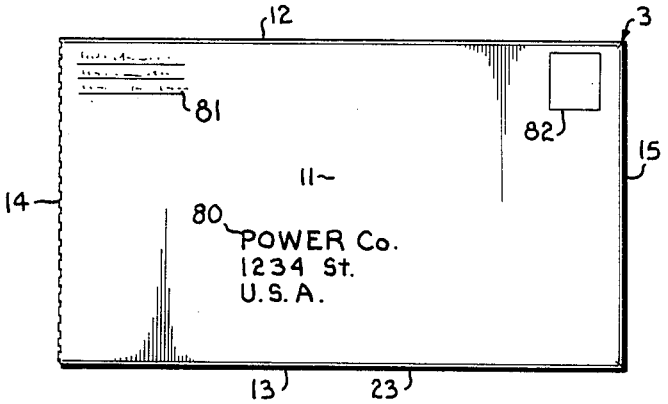
FIG. 5 is a front elevation of the envelope with the hanger removed.
Figure 6:
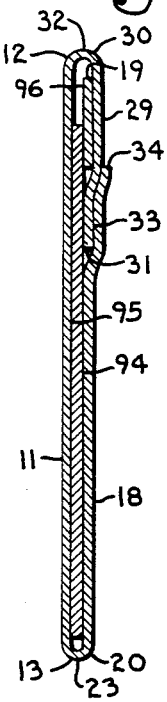
FIG. 6 is a vertical cross section of the envelope taken generally along line 6—6 in FIG. 2.
Figure 7:
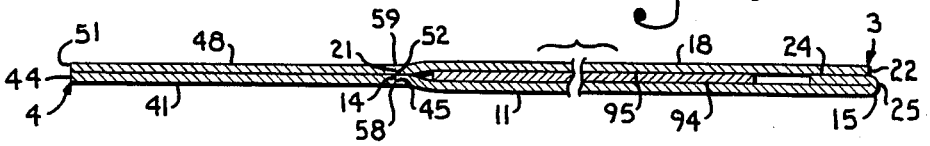
FIG. 7 is a transverse cross section of the envelope taken generally along line 7—7 in FIG. 1.
Figure 12:
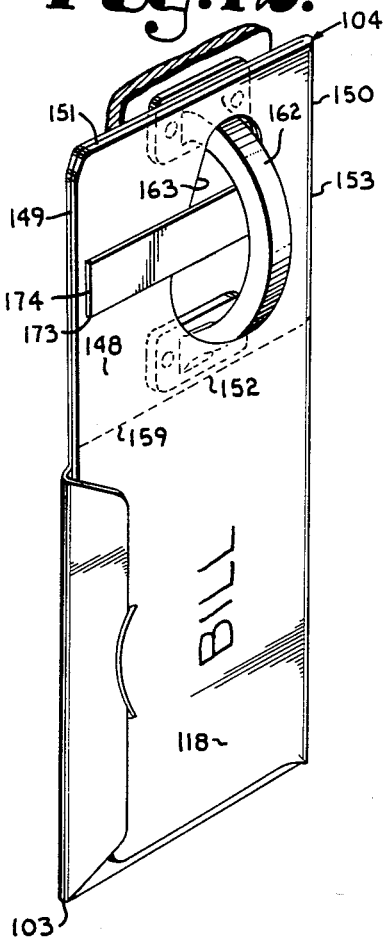
FIG. 12 is a perspective view of the modified envelope mounted on a door handle.
Figure 13:
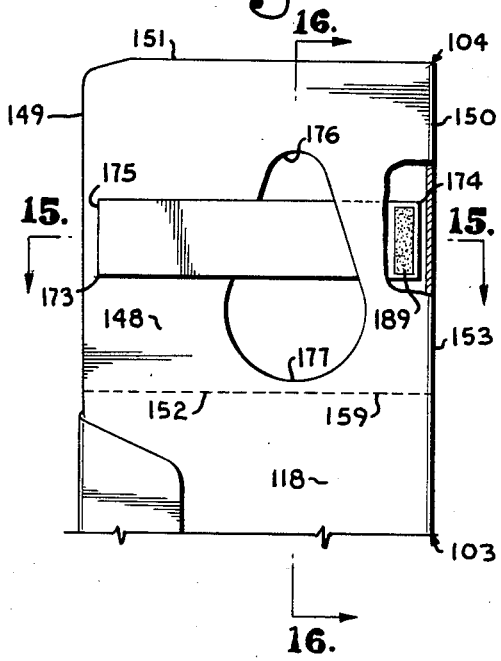
FIG. 13 is a fragmentary rear elevation of the modified envelope.
Figure 14:
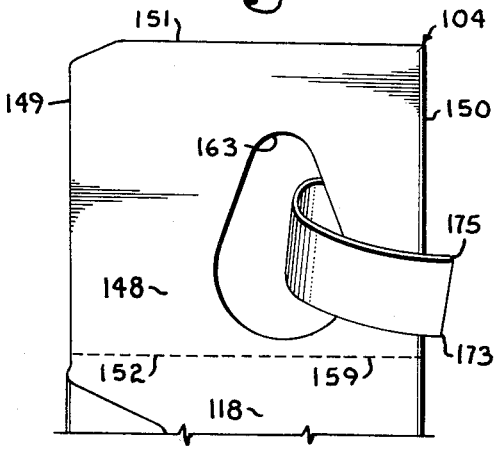
FIG. 14 is a fragmentary rear elevation of the modified envelope showing a tongue thereof bent back.
Figure 15:
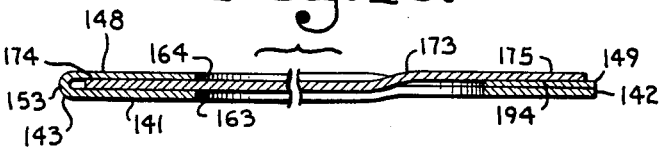
FIG. 15 is a vertical cross section of the modified envelope taken generally along line 15—15 in FIG. 13.
Figure 16:
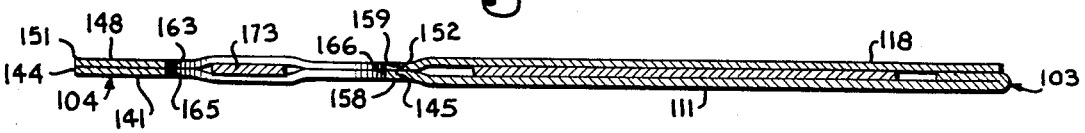
FIG. 16 is a transverse cross section of the modified envelope taken generally along line 16—16 in FIG. 13.

Since the recipients' mailboxes are not available for the receipt of hand-delivered mail, the envelope 1 is designed for attachment to either a doorknob 61 or a door handle 62 as shown in FIGS. 2 and 3 respectively. The doorknob 61 is mounted on a conventional solid core door 69 of the type which might form the front door of a dwelling unit. The door handle 62 is mounted on a storm door 70 which may be convertible to a screen door. In a typical installation, the storm door 70 is mounted on a door frame exteriorly of the door 69.

However, the storm or screen door 70 may be locked whereby the front door 69 is inaccessible to delivery persons. Even if the storm door 70 is open, it is more convenient and efficient to place the envelope 1 thereon than to open it for access to the front door 69. Since both types of doors 69, 70 are likely to be encountered on a given distribution route, the envelope 1 is adapted for removable attachment to either.

The doorknob 61 comprises a cylindrical shaft 67 terminating at an enlarged knob portion 68 in spaced relation from the door 69. The knob portion 68 is passed through the doorknob opening 63. It will be appreciated that the paper stock comprising the envelope blank 2 allows the hanger 4 and the doorknob opening 63 to be substantially distorted in order to receive the knob portion 68. For example, the side 64 may be pulled outwardly from the planes in which the hanger front and back panels 41, 48 normally lie whereby the doorknob opening 63 assumes a configuration which is somewhat circular or elliptical as required to receive a particular doorknob. Doorknobs having particularly large knob portions may be accommodated by tearing the hanger front and back panels 41, 48 to enlarge the doorknob opening 63.

The doorknob opening 63 has rounded ends 65, 66 which tend to distribute the stresses associated with deforming the hanger 4 and the opening 63 when the knob portion 68 is passed through the doorknob opening 63. Thus, portions of the hanger panels 41, 48 adjacent the doorknob opening 63 are less likely to be torn. The opening large second end 66 is positioned closer to the hanger tear line 76 than the opening first end 65 is to the hanger panel first side edges 44, 51 so that if the doorknob opening 63 is torn in order to receive a large doorknob the tear will most likely occur between the opening large second end 66 and the perforated tear line 76. Despite being torn thusly, the hanger 4 will function to suspend the envelope 1 from the doorknob 61.

With the hanger 4 positioned between the door 69 and the knob portion 68, the envelope 1 will drop downwardly to a position whereat the opening sides 64 engage the doorknob shaft 67. The envelope 1 is thus securely but removably attached to the door 69. The recipient merely deforms the doorknob opening 63 in a similar manner to pass the knob portion 68 therethrough or opens the doorknob opening 63 by tearing the hanger 4 surrounding same. As indicated previously, tear damage to the hanger 4 is of no consequence at this point since it is designed to be removed and discarded upon receipt and prior to mailing.

In placing the envelope 1 on the storm door 70, the tear line 76 of the door handle opening 72 is pressed against the handle 62 and thus torn open. The first and second receivers 74, 75 receive the handle 62. Edges 78 left by the tear line 76 tend to close between the door handle 62 and the storm door 70. The envelope 1 is thus removably mounted on the storm door 70.

As with the operation of the doorknob opening 63, the hanger 4 may be deformed as required to receive the door handle 62 in the receivers 74, 75. For example, the hanger 4 may be bent about an axis extending perpendicular to the perforated tear line 76 and assume an outwardly concave configuration. Also, the receivers 74, 75 may be torn if necessary to accommodate an oversize door handle. The second receiver 75 is closer to the front and back panel tear lines 58, 59 than the first receiver is to the hanger panel first side edges 44, 51. Therefore, it is more likely that the second receiver 75 will be torn open to the tear lines 58, 59 than that the first receiver 74 will be torn open to an edge of the hanger 4.

Upon removal of the envelope 1 from the storm door 70, the tear line edges 78 part sufficiently to pass the handle 62 therebetween.

The hanger 4 is designed for simplicity and economy of manufacture and relative strength for secure attachment to doorknobs and door handles, such as those shown at 61 and 62 respectively. The hanger front and back panels 41, 48 together form a double layer of envelope stock, yet are merely extensions of the envelope front and back panels 11, 18. The adhesive strip 86 is strategically placed in proximity to the hanger first side edges 44, 51 to not only hold them together but also to reduce the likelihood of the doorknob and door handle openings 63, 72 tearing out.

The adhesive spots 90, 91 and the adhesive strip 86 function to bond the hanger panels 41, 48 securely together. The stiffener flap 54 functions to not only secure the hanger panel upper edges 42, 49 together, but also lends rigidity to the area of the hanger 4 generally between and above the door handle receivers 74, 75. The stiffener flap 54 thereby helps to retain the hanger 4 over the door handle 62.

The seal flap 29 is designed for closing the envelope mouth 96 in different manners for a first and a second trip. For a first trip, the tab 33 is inserted in the slit 34. The envelope 1 may thus be easily opened by the first recipient for access to the materials 94 in the pocket 95. For a second trip, the first recipient moistens the adhesive strip 92 and folds the seal flap 29 over the back panel 48 in a sealing engagement whereby the envelope 1 is ready for mailing with the hanger 4 removed therefrom.

An envelope 101 comprising a first modified embodiment of the present invention is shown in FIGS. 11–16 and is substantially similar to the envelope 1 except for a modified hanger 104.

A body 103 of the modified envelope 101 is substantially similar to the body 3 of the envelope 1 and includes a front panel 141 with upper and lower edges 142, 143 and first and second side edges 144, 145. A back panel 148 displays upper and lower edges 149, 150 and first and second side edges 151, 152. The front and back panels 141, 148 are integrally connected and demarcated by a lower fold line 53.

The hanger front and back panels 141, 148 are integral with the body front and back panels 111, 118 and are demarcated therefrom by front and back perforated tear lines 158, 159.

A combination doorknob and door handle opening 163 extends through the hanger front and back panels 141, 148. The opening 163 is somewhat pear-shaped and includes sides 164 which converge toward the hanger panel first side edges 144, 151. The opening 163 also includes a rounded, small first end 165 in proximity to and spaced from the hanger panel first side edges 144, 151 and a rounded, large second end 166 in proximity to and spaced from the hanger panel second side edges 145, 152.

A tongue 173 includes a fixed end 174 attached by an adhesive spot 189 to the hanger 104 between its panels 111, 118 adjacent to its lower edge 143. The strip 173 extends from an opening side 164 and terminates at a free end 175. The tongue 173 extends parallel to the panel side edges 144, 145, 151 and 152 between the opening sides 164 whereby the opening 163 is divided into first and second receivers 176, 177 adjacent the opening ends 165, 166 respectively.

The hanger panels 141, 148 are connected by an adhesive spot 190 adjacent the corners formed by their upper edges 142, 149 and their first side edges 144, 151. The hanger front and back panels 141, 148 are not glued between the opening 163 and the panel upper edges 142, 149 whereby a hanger pocket 194 is formed between the inner surfaces of the panels 141, 148.

In use, the opening 163 is adapted to receive a doorknob in the same manner as the doorknob opening 63 of the previous envelope embodiment 1. When the knob portion 68 is inserted through the opening 163, the tongue 173 merely folds out of the way.

For attachment to a storm door 170, the door handle 162 is inserted into the opening 163 and the tongue 173 is inserted through the handle 162. The tongue fixed end 174 may then be inserted through an opening side 164 into the hanger pocket 194 between the extension panels 141, 148. Alternatively, the tongue fixed end 174 may be placed against the outside surface of whichever hanger panel 141, 148 is facing outwardly from the storm door 170. Either way, the envelope 101 is securely attached to a door.

The opening 163 is positioned on the extension 104 so that its first end 165 is spaced further from the hanger panel first side edges 144, 151 than the opening second end 166 is spaced from the panel second side edges 145, 152. Therefore, if the opening 163 is torn to accommodate a larger-than-normal doorknob, most likely the tear will extend from the opening second end 166 to the perforated tear lines 158, 159. A tear in this area is of no consequence. However, tearing the opening 163 open at its first end 165 is undesirable since it might prevent the attachment of the envelope 161 to a door. Therefore, additional space is provided around the opening first end 165 to minimize this possibility.

It is to be understood that while certain forms of the present invention have been illustrated and described herein, it is not to be limited to the specific forms or arrangement of parts described and shown.

What is claimed and desired to be secured by Letters Patent is as follows:

1. An envelope adapted for attachment to one of a doorknob and a door handle, which comprises:

(a) a body including:

(1) a front panel with upper, lower, first side and second side edges;

(2) a back panel with upper, lower, first side and second side edges;

(3) said body panels being integrally connected at a body fold line extending along their lower edges;

(4) a side flap integrally connected to one of said body panels at a second side edge thereof and demarcated therefrom by a side flap fold line;

(5) a seal flap having proximate and distal edges, said seal flap being integrally connected to said body front panel and demarcated therefrom by a seal flap fold line extending along said body front panel upper edge and said seal flap proximate edge; and (6) said body panels being folded over each other along said body panel fold line, said side flap being attached to the other of said body panels and said body panels being attached along their respective first side edges whereby a pocket is formed between said body panels; and (b) a hanger including:

(1) a hanger front panel with upper, lower, first side and second side edges, said hanger front panel being integrally connected to said body front panel and demarcated therefrom by a front panel tear line extending along said body front panel first side edge and said hanger front panel second side edge;

(2) a hanger back panel having upper, lower, first side and second side edges, said hanger back panel being integrally connected to said body back panel and demarcated therefrom by a back panel tear line extending along said body back panel first side edge and said hanger back panel second side edge;

(3) said hanger panels being integrally connected and demarcated by a hanger fold line extending along said hanger panel lower edges;

(4) said hanger panels being folded over each other along said hanger fold line and attached together in mutually opposing relation;

(5) a doorknob opening extending through said hanger panels and having a small first end in proximity to and spaced from said hanger panel first side edges, a large second end in proximity to and spaced from said hanger panel second side edges and a pair of side edges connecting said doorknob opening ends and converging toward said doorknob opening small end; and (6) a door handle opening extending through said extension panels and including a pair of spaced-apart receivers interconnected by a door handle opening tear line extending therebetween and adapted to pass a door handle into said receivers.

2. The envelope according to claim 1, which includes:

(a) a tab extending from said seal flap distal edge; and (b) said back body panel having a slit adapted to receive said tab.

3. The envelope according to claim 1, which includes:

(a) a stiffener flap extending from said hanger front panel upper edge and demarcated therefrom by a stiffener flap fold line, said stiffener flap having seal adhesive thereon and being folded along said stiffener flap fold line over said hanger back panel and attached thereto by said seal adhesive.

4. An envelope, which comprises:

(a) a body having:

(1) a front panel;

(2) a back panel attached to said front panel whereby a pocket is formed therebetween;

(3) an edge along said front and back panels; and (4) a seal flap attached to one of said front and back panels and attachable to the other of said front and back panels; and (b) a hanger attached to said body along said edge thereof and including attachment means for attaching said envelope to one of a doorknob and a door handle;

(c) said attachment means comprising:

(1) an opening through said hanger adapted to receive one of a doorknob and a door handle; and (2) a tongue extending across at least a portion of said opening and adapted for insertion through a door handle, and wherein (d) said opening includes opposite sides;

(e) said tongue extends from one of said opening sides; and (f) said hanger includes a pocket open at the other of said opening sides adapted to receive said tongue.

5. The envelope according to claim 4 which includes:

(a) said hanger comprising front and back panels interconnected in opposing relation;

(b) said hanger pocket being formed between said hanger panels; and (c) said tongue having a fixed end attached to said hanger between said panels thereof and a free end adapted for insertion into said hanger pocket.

6. In an envelope having a body with front and back panels forming a pocket therebetween and a seal flap adapted for enclosing said pocket, the improvement of a hanger attached to said body and demarcated therefrom by a tear line which comprises:

(a) a doorknob opening extending through said hanger and adapted to receive a doorknob therethrough; and (b) a door handle opening having a pair of spaced-apart receivers and means for passing a door handle through said hanger and into said receivers (c) said hanger further comprising front and back panels integrally connected to and extending from said body front and back panels respectively;

(d) said hanger panels being integrally connected and demarcated by a hanger fold line, and (e) a stiffener flap extending from one of said hanger panels and being demarcated therefrom by a stiffener flap fold line;

(f) said stiffener flap being folded along said stiffener flap fold line over the other of said panels and attached thereto, (g) said stiffener flap being positioned at least partly between said door handle receivers.

* * * * *